US007452164B2

(12) United States Patent
Kim

(10) Patent No.: US 7,452,164 B2
(45) **Date of Patent: *Nov. 18, 2008**

(54) RETAINING WALL SYSTEM WITH INTERLOCKED WALL-BUILDING UNITS

(75) Inventor: Hun S. Kim, North Vancouver (CA)

(73) Assignees: Beon Top Enterprises Ltd., North Vancouver (CA); Versa-Lok Asia Inc., Shenton House (SG)

( * ) Notice: Subject to any disclaimer, the term of this patent is extended or adjusted under 35 U.S.C. 154(b) by 0 days.

This patent is subject to a terminal disclaimer.

(21) Appl. No.: 11/460,185

(22) Filed: Jul. 26, 2006

(65) Prior Publication Data

US 2006/0257212 A1 Nov. 16, 2006

Related U.S. Application Data

(63) Continuation-in-part of application No. 10/842,620, filed on May 10, 2004, now Pat. No. 7,083,364, which is a continuation of application No. 09/958,369, filed on Oct. 6, 2001, now abandoned, which is a continuation of application No. PCT/CA00/00370, filed on Apr. 7, 2000.

(30) Foreign Application Priority Data

Apr. 8, 1999 (CA) ..... 2268509

(51) Int. Cl.
*E02D 29/02* (2006.01)

(52) U.S. Cl. ..... 405/284; 405/262

(58) Field of Classification Search ..... 405/284, 405/286, 262

See application file for complete search history.

(56) References Cited

U.S. PATENT DOCUMENTS

| | | | |
|---|---|---|---|
| 3,922,832 | A | 12/1975 | Dicker |
| 4,486,115 | A | 12/1984 | Rionda et al. |
| 4,486,121 | A | 12/1984 | Thompson et al. |
| 4,488,389 | A | 12/1984 | Farmont |
| 4,650,368 | A | 3/1987 | Bayer |
| 4,671,706 | A | 6/1987 | Giardini |
| 4,779,393 | A | 10/1988 | Jong |
| 4,891,927 | A | 1/1990 | Kairi et al. |
| 4,998,397 | A | 3/1991 | Orton |
| 5,145,288 | A | 9/1992 | Borcherdt |
| 5,580,191 | A | 12/1996 | Egan |
| 5,584,599 | A | 12/1996 | Knittel |

(Continued)

FOREIGN PATENT DOCUMENTS

| | | |
|---|---|---|
| JP | S51-137832 | 11/1976 |

(Continued)

*Primary Examiner*—Frederick L Lagman
(74) *Attorney, Agent, or Firm*—Oyen Wiggs Green & Mutala LLP

(57) ABSTRACT

A retaining wall structure built of wall-building units such as sand/soil bags or hardenable building units such as clay bricks has interconnecting members placed between adjacent courses of units to attach the adjacent courses to one another. The interconnecting members have projections on both sides which protrude into the wall-building units of the adjacent courses. Sheets of geogrid preferably extend from between some of the courses of wall-building units into the fill retained by the wall-building units. Projections on the interconnecting members protrude through holes in the geogrid sheet, anchoring the wall face to the reinforced soil structure.

13 Claims, 17 Drawing Sheets

U.S. PATENT DOCUMENTS

| | | | | |
|---|---|---|---|---|
| 5,934,027 | A | 8/1999 | Khalili | |
| 7,083,364 | B2 * | 8/2006 | Kim | 405/284 |

FOREIGN PATENT DOCUMENTS

| | | |
|---|---|---|
| JP | 59048525 | 3/1984 |
| JP | 04108916 | 4/1992 |
| JP | 04108923 | 4/1992 |
| JP | 06322730 | 11/1994 |
| JP | 07166551 | 6/1995 |
| JP | 2001011838 | 1/2001 |

* cited by examiner

RETAINING WALL SYSTEM WITH INTERLOCKED WALL-BUILDING UNITS

CROSS-REFERENCE TO RELATED APPLICATIONS

This application is a continuation-in-part of application Ser. No. 10/842,620, filed May 10, 2004, now U.S. Pat. No. 7,083,364, issued Aug. 1, 2006, which is a continuation of application Ser. No. 09/958,369, filed Oct. 6, 2001, now abandoned.

TECHNICAL FIELD

The invention pertains to retaining walls and to methods of constructing retaining walls. In particular, it pertains to retaining walls built of units such as sand/soil bags or hardenable units such as fresh clay bricks, wherein the units in adjacent courses are connected together.

BACKGROUND

Retaining walls are used in a wide variety of civil engineering and landscaping applications, for example to support slopes and embankments for highways and railways, support noise barriers, etc. Retaining walls are commonly made having a supporting face structure made of interconnecting blocks with soil or other fill placed and compacted in back of the wall, and with sheets of geogrid laid in the fill at various levels, extending back from the wall. The geogrid sheets, which stabilize the backfill, are often attached to the interlocking blocks.

It is known to build retaining walls of sandbags instead of interlocking blocks to hold the backfill. In the prior art, sandbags in retaining walls are not attached to each other, relying essentially on their mass to stabilize the wall. This limits the steepness and the height of retaining walls that can be build with sandbags. Sandbag retaining walls, in the prior art, are normally temporary, rather than permanent, structures.

Also, it is known to build retaining walls with blocks of various kinds. Such blocks, in the prior art, generally need to be made with interfitting parts or be affixed by concrete or the like in order to make a secure stable retaining wall.

Japanese Abstract JP-A-06-322730 published Nov. 22, 1994 shows the use of a disc-like solid with a projection on both sides to prevent slippage between bags of ready-mix concrete in a retaining wall. However, such device can prevent slippage only between two vertically-adjacent bags. Japanese abstract JP-A-59-048525 published Mar. 19, 1984 shows the use of sand and soil bags provided integrally on the ends of water-permeable sheets which extend into fill in back of a vertical bank.

SUMMARY OF INVENTION

The invention provides a permanent retaining wall structure in which the wall-building units, such as sand/soil bags, used to make the face of the structure are attached to wall-building units in adjacent courses, and preferably to geogrid sheets. The attachment is done by means of a plate having projections on both sides thereof which protrude into the wall-building units in adjacent courses, and which also protrude through the holes in the geogrid sheets, stabilizing the retaining wall structure and backfill.

In one embodiment of the invention, the wall-building units are bags of sand, soil or similar fill material. In this specification, "sand/soil bag" means a bag filled with any suitable fill material, including sand, soil, mixtures thereof and including fill mixed with seeds for grass or other plants. In another embodiment, the wall-building units are units that harden, or that can be made to harden, after they are placed in the wall and interconnected together by means of the attachment devices of the invention. Examples are freshly-formed bricks of clay or similar material prior to their hardening; or bags of cement or a mixture of cement and aggregate that can be made to harden by wetting them and allowing them to cure after they are set in place. Such wall-building units are collectively referred to as "hardenable building units" in this specification. Thus "wall-building units" can be either "sand/soil bags" or "hardenable building units," the distinction being that the former have fill that remains friable after the wall is made and the latter harden or cure after the wall is constructed, forming rigid units.

The invention provides a retaining wall structure comprising a first plurality of wall-building units positioned adjacent to one another forming a first, horizontally-extending course; a second plurality of wall-building units positioned adjacent to one another above the first course forming a second course; and interconnecting members placed between the first and second courses attaching them together. The interconnecting members comprise a plate having an upper side and a lower side, a first set of projections on the lower side and a second set of projections on the upper side, the projections being capable of protruding into a wall-building unit. The interconnecting members are positioned between the wall-building units of the first and second courses so that the first set of projections protrudes into a unit in the lower course and the second set of projections protrudes into a unit in the upper course. The interconnecting members may also be placed on the ground or on a footing, under the base course of wall-building units.

The retaining wall structure can optionally comprise a sheet of geogrid extending from between adjacent courses into backfill behind the retaining wall. The geogrid sheet is positioned so that projections of the interconnecting member protrude through holes in the sheet.

The invention also provides an interconnecting member for attaching a first horizontally-extending course of wall-building units to a second horizontally-extending course positioned vertically adjacent to the first course. The member comprises a plate having an upper and lower side with a set of projections on each side capable of protruding into a wall-building unit. The projections can also serve the function of providing attachment means for a sheet of geogrid, but preferably, the interconnecting member includes a set of geogrid-holding members on the upper side of the plate that are shaped and adapted specifically to protrude through holes in a sheet of geogrid. There may be retaining caps affixed to the geogrid-holding members for retaining a sheet of geogrid thereon. The interconnecting member may also have a flange around the base of each projection on the upper side of the plate, having a lip for sealing against a wall-building unit.

The retaining wall structure can also optionally include cover plates to improve the durability and appearance of the wall.

The invention also provides a method of constructing a retaining wall structure having a plurality of courses of wall-building units. The method comprises the steps of placing a first plurality of wall-building units adjacent to one another to form a first, horizontally-extending course; placing interconnecting members on the first course, the interconnecting members having a first set of projections on their lower side and a second set of projections on their upper side, such that the projections in the first set protrude into wall-building units in the first course of wall-building units; and placing a plurality of wall-building units adjacent to one another to form a second course above the first course, such that the projections of the second set protrude into wall-building units of the second course. The method of constructing a retaining wall can include the step of placing a sheet of geogrid extending from between the courses of wall-building units into the backfill, with projections of the interconnecting member protruding through holes in the geogrid to anchor it in place.

DESCRIPTION

Figure 1:
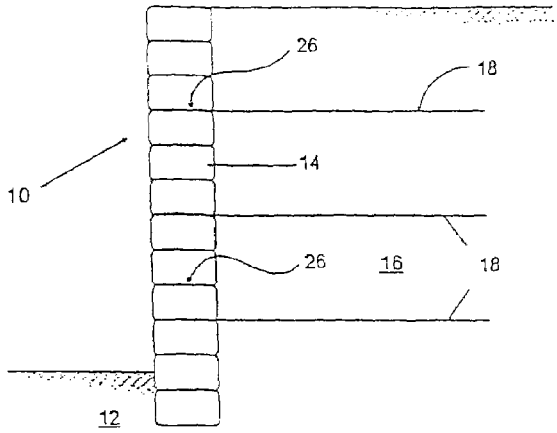
FIG. 1 is a cross-sectional end view of a retaining wall structure according to one embodiment of the invention.

Referring to FIG. 1, retaining wall structure 10, constructed on ground 12, comprises a plurality of horizontally-laid courses of sand/soil bags 14, the courses being arranged vertically in a wall structure. The face of the wall may be sloped, rather than vertical, if so preferred for a particular application. The bags 14 are preferably made of a geotextile material which is durable and of a weave which permits water to flow in and through the bag, and seedlings to grow out, while retaining fine soil particles within the bags. The material of the bags 14 should not be biodegradable, for durability of the wall.

Backfill 16 is compacted behind and supported by sand/soil bags 14. Geogrid sheets 18 extend horizontally back into the backfill from between courses of sand/soil bags 14, affixed thereto as described hereunder. Interconnecting members 26 are placed between the adjacent courses of sand/soil bags 14.

Figure 2:
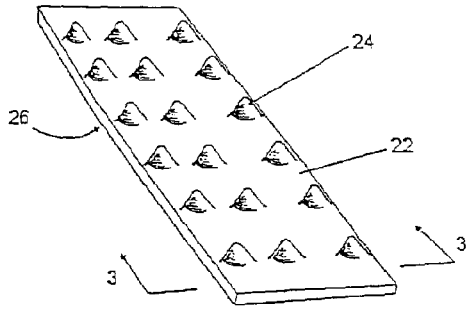
FIG. 2 is a perspective view of one embodiment of an interconnecting member.
Figure 3:
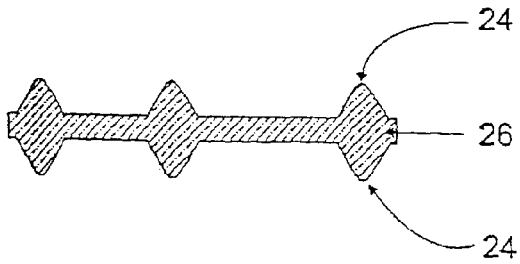
FIG. 3 is a cross-sectional view on the line 3-3 of FIG. 2.

Referring to FIGS. 2 and 3, interconnecting member 26 comprises a plate 22, generally rectangular and planar in a preferred embodiment, with a plurality of projections 24 extending vertically from both sides of the plate 22. Projections 24 are sufficiently strong and pointed to protrude into sand/soil bags 14. Interconnecting member 26 is preferably made of plastic or aluminum or other non-corrosive metal or material.

Figure 4:
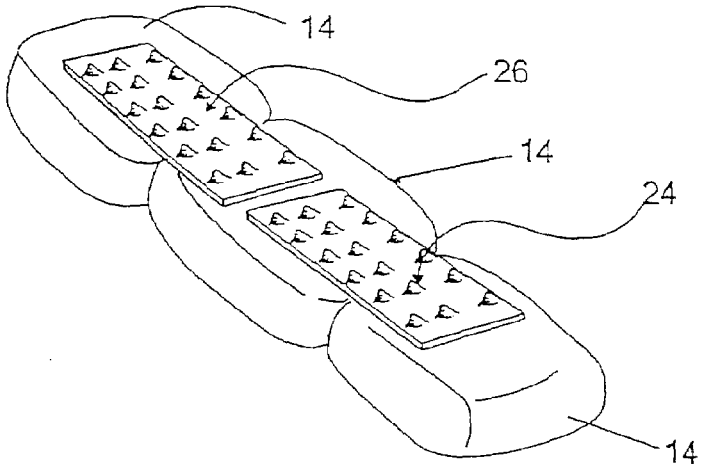
FIG. 4 is a perspective view of a course of sand/soil bags with interconnecting members positioned thereon.
Figure 5:
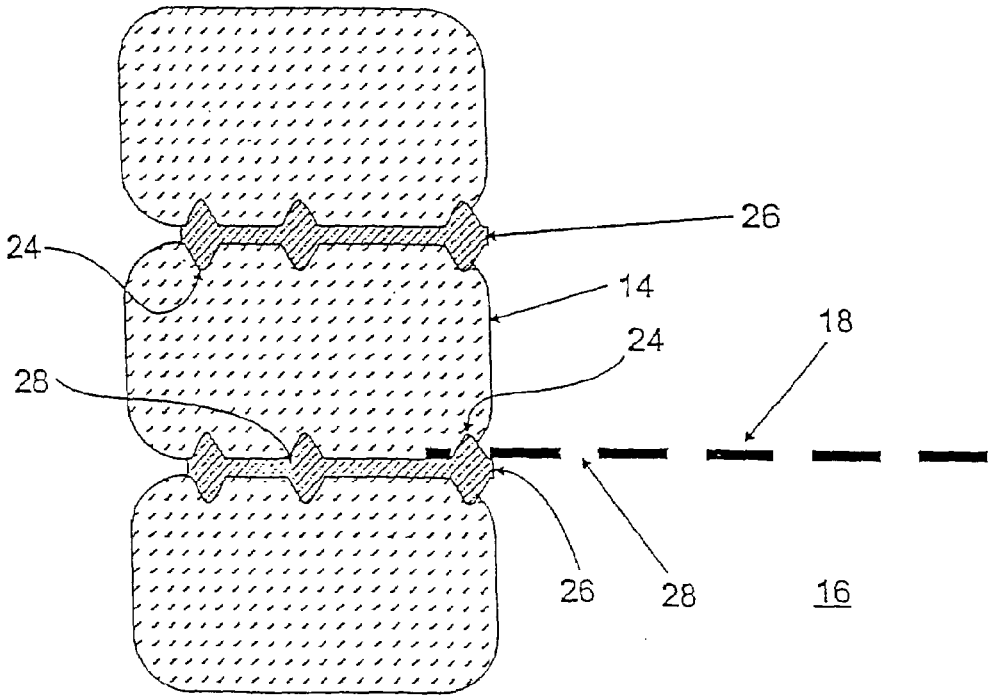
FIG. 5 is a cross-sectional view through adjacent, interconnected sand/soil bag courses.

Referring to FIGS. 4 and 5, interconnecting members 26 are used in the construction of a retaining wall structure 10 by placing them on top of sand/soil bags 14 in a course so that projections 24 on the lower side protrude into the bags. A second course of bags is placed on top of the first course and of interconnecting members 26. The projections on the upper side of member 26 protrude into the bags in the second course, and the weight of those sand/soil bags presses the interconnecting members so that the projections on their lower side protrude fully into the bags in the first course. The projections 24 can be configured to fully penetrate the bags or, preferably, to simply indent them. In either case, the projections are considered to "protrude" into the bags.

The interconnecting members 26 are also used to anchor geogrid sheets to the sandbags. Geogrid sheets 18 are known and commercially available plastic mesh products commonly used for soil reinforcement. Referring to FIG. 5, geogrid sheet 18 has a plurality of holes 28 therein. The sheet 18 is affixed to the face of the wall by placing the edge of the sheet over interconnecting members 26 atop a course of sandbags 14 so that the projections 24 on the upper side of the interconnecting member and adjacent its back edge protrude through holes 28 in the geogrid. When the next upper course of bags 14 is put on top, projections 24 on the upper side of the interconnecting member, extending through the geogrid sheet, protrude into the underside of the bags in said upper course.

Instead of being placed over an interconnecting member 26, the geogrid sheet can be placed directly on top of a course of sand/soil bags and the interconnecting members placed over it, with the projections 24 on the lower side of the member 26 protruding down through holes 28 in the geogrid sheet and into the bags. In other words, the geogrid can be placed under the interconnecting member instead of over it.

Geogrid sheets are installed at selected levels during the construction of the wall, for example on top of every third course of bags, or as required for a particular application.

Figure 6:
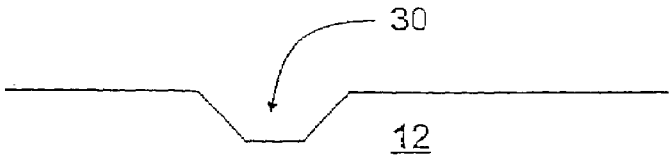
FIGS. 6(*a*) to (*e*) illustrate steps in a method of constructing a retaining wall structure.
Figure 6:
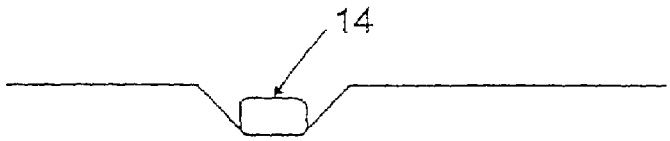
Figure 6:
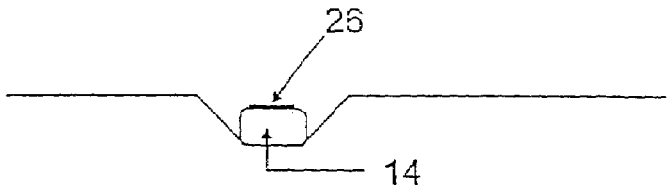
Figure 6:
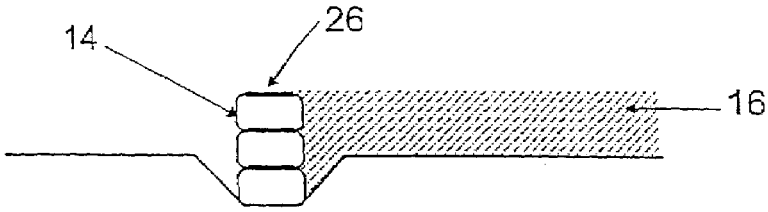
Figure 6:
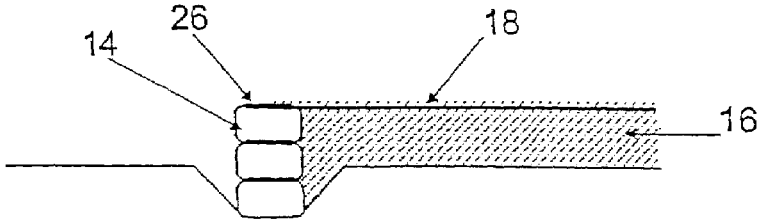

FIG. 6 illustrates the steps in a preferred method of constructing a retaining wall structure according to the invention. Referring to FIG. 6(*a*), a trough 30 is dug in ground 12, with the base of the trough being suitably prepared with a levelling pad or a concrete footing in order to support the wall. Such preparation is conventional in the building of retaining walls. A first course of sand/soil bags 14 is laid in trough 30 (FIG. 6(*b*)). A row of interconnecting members 26 is placed on top of bags 14 in the first course (FIG. 6(*c*)). Next, a further course of bags 14 is laid, and backfill 16 is placed and compacted in back of the sand/soil bags. A row of interconnecting members 26 is laid on it and then a further course of bags 14 (FIG. 6(*d*)). Then, a row of interconnecting members 26 is placed along the uppermost course of bags 14 and a sheet of geogrid 18 is placed on it, extending back along the surface of the backfill 16 (FIG. 6(*e*)). The construction of the wall is continued in the same manner, until a retaining wall of the required height is completed, as shown in FIG. 1.

In some applications, it is desirable to place interconnecting members 26 on the ground under the base course of bags 14. Here, a row of interconnecting members 26 is placed on the levelling pad or concrete footing and the first or base course of bags 14 is placed on it. The wall is then further constructed as described above. This reduces movement or slippage of the base course of bags and assists in their being properly positioned.

Figure 34:
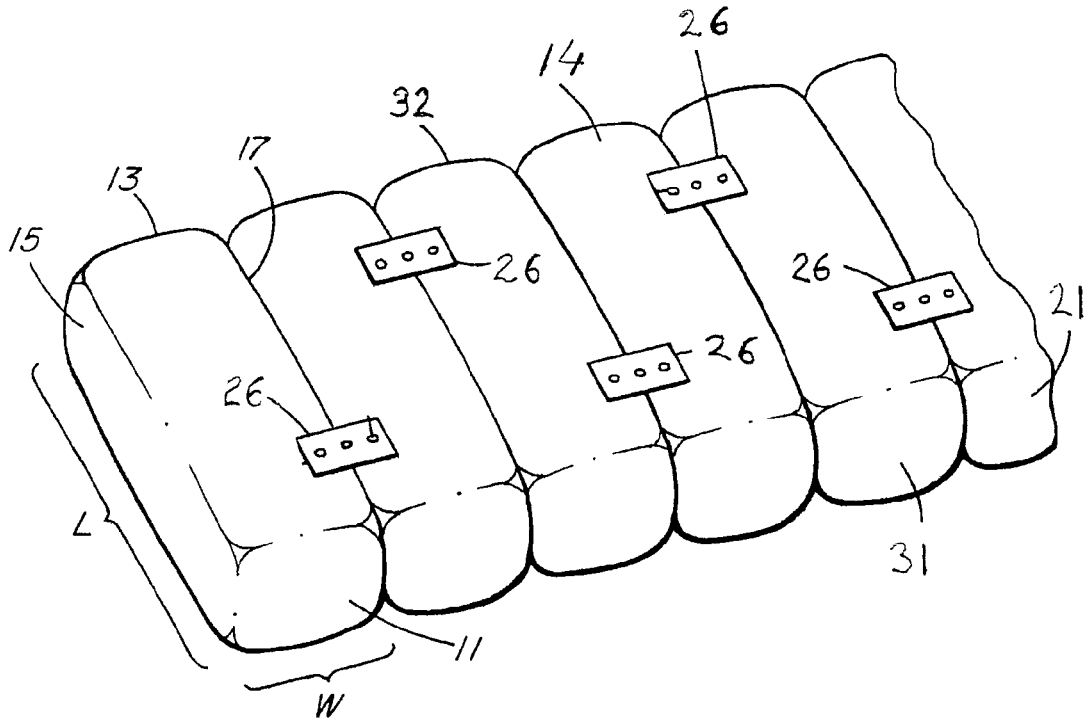
FIG. 34 is a top perspective view of a course of sand/soil bags laid according to another embodiment of the invention.

In another embodiment of the invention, some or all of the wall-building units in one or more courses are positioned at about a right angle to the slope that is being reinforced. FIG. 34 illustrates one form of this. The sand/soil bags 14 in a course 21 are positioned at about a right angle to the slope. They are laid adjacent to one another along their lengths, i.e. with sides 15, 17, of adjacent sand/soil bags abutting each other. The outer side 31 of the wall face is accordingly formed of ends 11 of the sand/soil bags, and the inner side 33 of the wall face is formed of the opposed ends 13 of the sand/soil bags. The wall face is accordingly deeper and has a higher density of sand/soil bags than a wall constructed with the sand/soil bags laid end to end, in which the thickness of the wall face is defined by the width of the bags rather than their lengths, the width being lesser than the length.

Sand/soil bags 14 have a width W and length L, the length being greater than the width, and opposed ends 11, 13 and opposed sides 15, 17.

Figure 35:
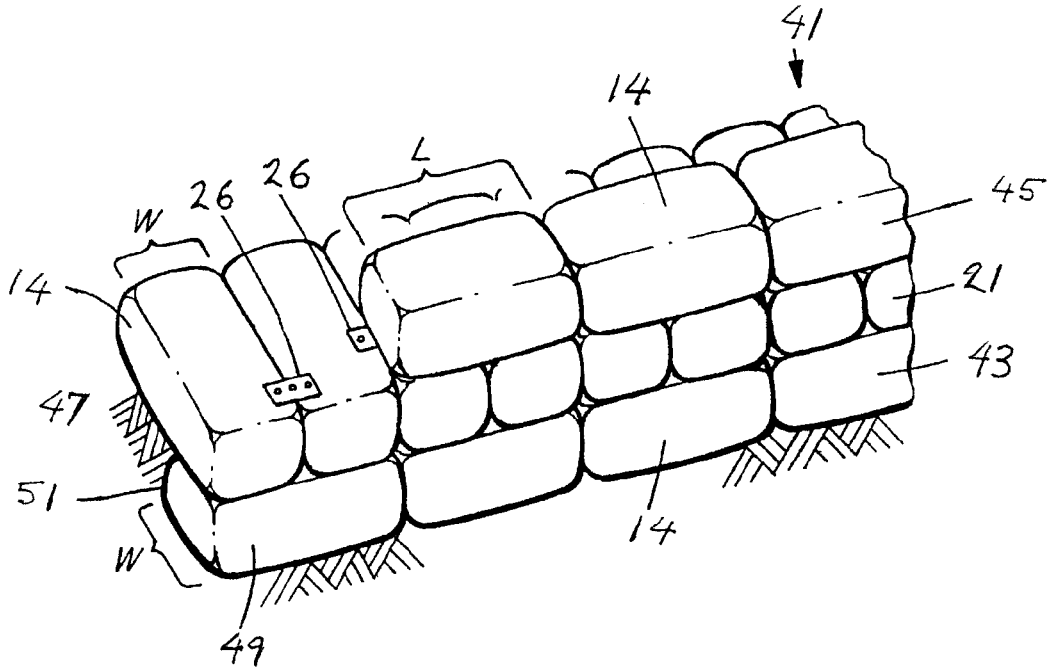
FIG. 35 is a perspective view of a portion of a retaining wall according to another embodiment of the invention.

In another embodiment of the retaining wall, shown in FIG. 35, a course 21 of sand/soil bags 14 that are laid side to side along their lengths is used in conjunction with other courses of sand/soil bags that are laid end to end. Retaining wall 41 comprises a course 21 of sand/soil bags 14 laid side to side along their lengths between a vertically-adjacent lower course 43 and a vertically-adjacent upper course 45, both of which comprise sand/soil bags 14 laid end to end. The wall 41 includes additional courses of sand/soil bags laid in the orientation of course 21 or the orientation of courses 43, 45, to a height required for a particular application. In retaining wall 41, the inner side of the wall face is not even, as the sand/soil bags in course 21 extend farther into the slope 47 than the sand/soil bags of courses 43, 45, so some fill may be used in back of courses 43, 45. Interconnecting members 26 are positioned along each course to attach together the vertically-adjacent sand/soil bags within each course and the vertically-adjacent sand/soil bags of the adjacent courses. The interconnecting members are positioned in a staggered arrangement, with every second interconnecting member positioned proximate to the outer side 49 of the wall face and alternating ones positioned proximate to the inner side 51. It will be understood that the latter interconnecting members are positioned proximate to the inner side of the sand/soil bags of courses 43, 45 so as to fully engage the sand/soil bags that are positioned end to end.

The embodiments shown in FIGS. 34 and 35 may be used with or without geogrid sheets being attached to the wall.

According to one embodiment of the invention, bags 14 include seeds of grass or other ground covers mixed in their fill. After the retaining wall is built, the bags are watered, naturally or artificially, and the ground cover plants grow out of the bags, providing a green foliage face on the retaining wall.

According to another embodiment of the invention, the bags do not include seeds but are instead made in shapes which, in a completed wall, will form an attractive wall face. For example, the face side of the bags can be rectangular, square or hexagonal, to permit the construction of a wall face with any of various interlocking patterns. The bags can also be of transparent material, such as plastic, and in such case the fill can be decoratively colored. For example, the fill can be green-colored gravel.

Figure 7:
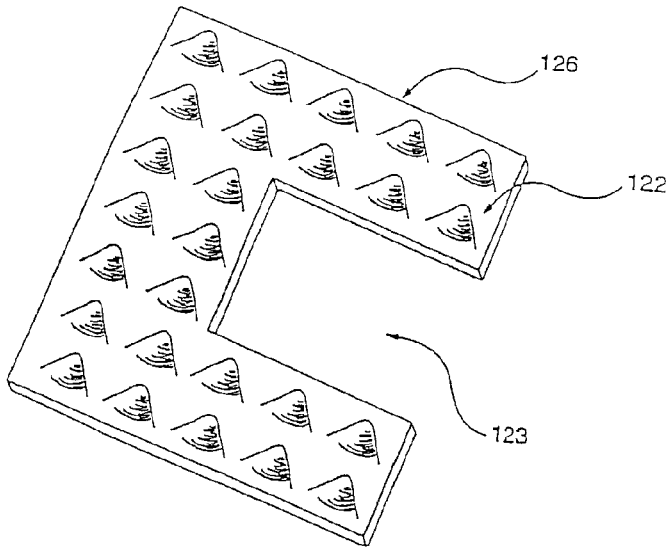
FIG. 7-10 are perspective views of alternate embodiments of the interconnecting member.
Figure 8:
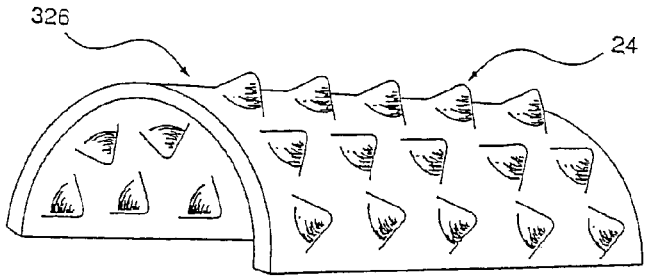
Figure 9:
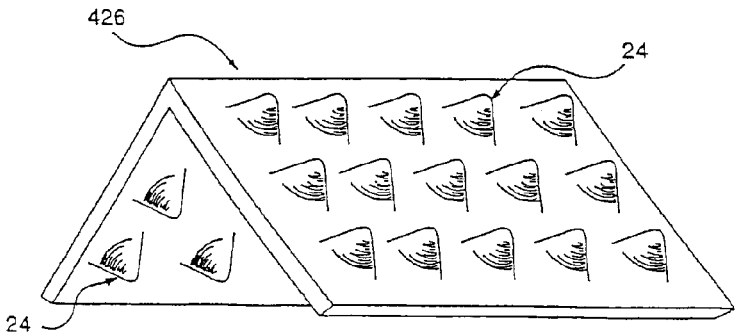
Figure 10:
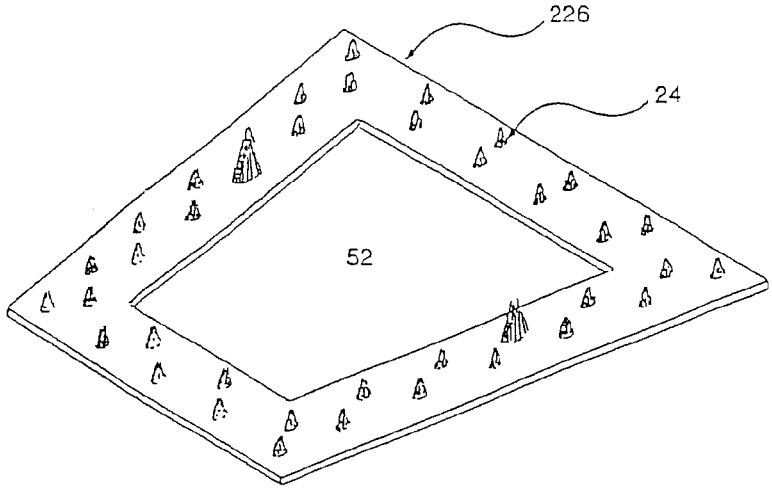

FIGS. 7-10 illustrate alternative embodiments of the interconnecting member. In these embodiments, the interconnecting member has different shapes to permit optimal interlocking of bags of various shapes and in various arrangements. Rounded or shapeless bags may have gaps between adjacent bags in a course such that an interconnecting member extending across such bags is not fully supported across such gap by the lower bags. In such cases it is preferable to use an interconnecting member with a cut-out in the unsupported area, so that an upper bag does not press down on an unsupported part of the interconnecting member. In FIG. 7, interconnecting member 126 comprises plate 122 with projections 24 on both sides thereof. The plate 122 is generally C-shaped with a space or cut-out 123 between the arms of the C. The interconnecting member 126 is positioned between courses of sand/soil bags such that the space 123 is above the gap between adjacent bags in the lower course. A portion of the bag in the upper course extends through the space 123 and rests directly on the lower bags. Also, the design of FIG. 7 permits a reduction in the amount of plastic or other material required for the member and is accordingly less costly. A similar design is shown in FIG. 10, in which interconnecting member 226, having projections 24 on both sides thereof, is in the form of a generally trapezoidal frame with a cut-out 52 in the middle thereof. As with the embodiment of FIG. 7, this interconnecting member permits part of the upper bag to rest directly on the lower bags while still interlocking bags in adjacent courses together. The narrower side of the trapezoidal frame is intended to be positioned rearward, with the geogrid attaching only to said narrower side. Again, such design effects a cost savings with regard to the amount of material required to make the interconnecting member.

Two further alternate configurations are shown in FIG. 8 and FIG. 9. In FIG. 8, interconnecting member 326 is a plate that is hemi-cylindrical in shape. In FIG. 9, interconnecting member 426 is a plate that is L-shaped. Both these forms of interconnecting members are adapted for use in interlocking sand/soil bags of the appropriate shapes. For example, the plate of FIG. 9 can be used where the bags 14 have a face or cross-section that is hexagonal. The plate of FIG. 8 can be used where the cross-section of the bags is round. The shaping of the plate, as in FIGS. 8 and 9, to fit shaped bags ensures secure contact between the plate and the bags. It will be apparent that the interconnecting member can be configured as required to interlock sand/soil bags of any desired shape.

In another embodiment of the invention, the wall-building units are hardenable building units. For example, the hardenable building units can be freshly-formed bricks of clay, concrete or similar material used prior to their hardening; or they can be bags of cement, or a mixture of cement and aggregate, or mixtures of cement with soil, bentonite, clay, etc., that can be made to harden by wetting them and allowing them to cure after they are set in place; or any similar material that is sufficiently soft to be penetrated by the projections of the interconnecting members but which hardens (for example by drying out, as in the case of a clay or concrete brick) or that can be made to harden (for example by wetting and then allowing to cure, as in the case of a bag of cement or cement and aggregate) after it is set in place. The hardenable building units must be firm enough at the time of use to retain their form and to be stackable, i.e. capable of being stacked without collapsing or breaking. In the case of freshly-formed clay or concrete blocks, such blocks should be semi-hardened.

The hardenable building units can include reinforcement elements, including fibers, wires and strips. Examples include polymeric fibers, such as polypropylene fibers, small steel wires, strips of polymeric resin or strips of metal. Such reinforcing elements can be incorporated in every kind of hardenable building units, and when the units harden, the reinforcing elements strengthen the retaining wall structure in a manner similar to the functioning of rebar in concrete building elements. A retaining wall made using hardenable building units is made in the same manner as described above for retaining walls where the wall-building units are sand/soil bags. Here, the method of making a retaining wall includes the additional step of allowing, or causing, the hardenable building units to harden. For example, where the hardenable building unit is a clay brick, it is used in the construction of the retaining wall when it is still soft enough to be easily penetrated by the projections 24 of the plate 122. As the wall is built, the clay bricks gradually cure and harden. Where the hardenable building unit is a bag of cement, or cement and aggregate, it is used in the same manner as the sand/soil bags as described above to construct the retaining wall; then, the bags are wetted and allowed to cure, causing the cement or cement and aggregate in each bag to harden. As described above in respect of the construction of walls made from sand/soil bags, a row of interconnecting members 26 can also be used under the base course of hardenable building units.

Figure 13:
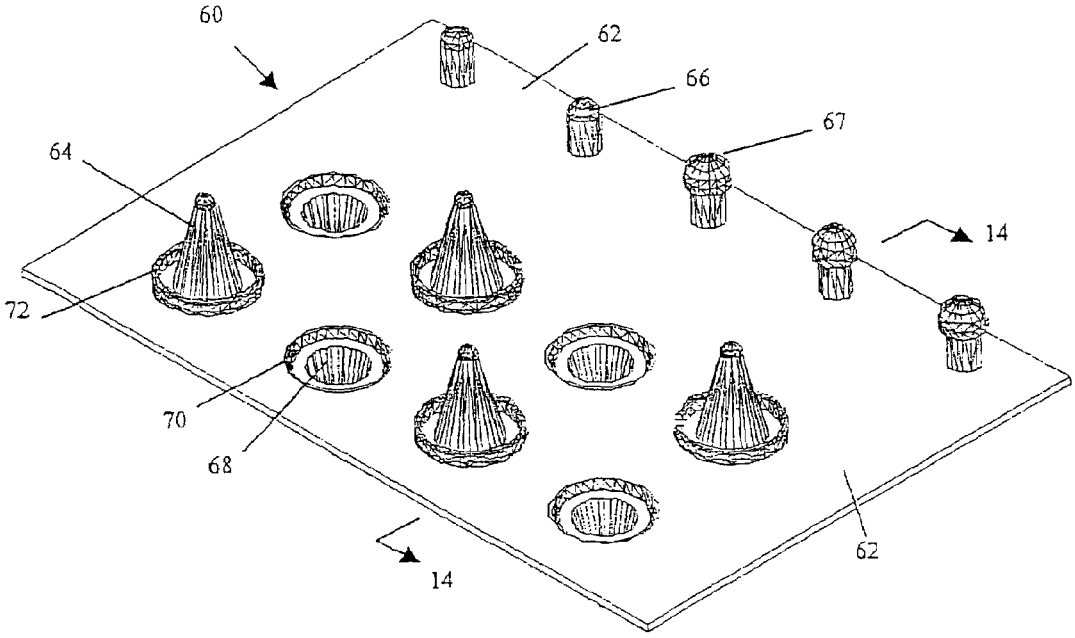
FIG. 13 is a perspective view of a further embodiment of the interconnecting member.
Figure 14:
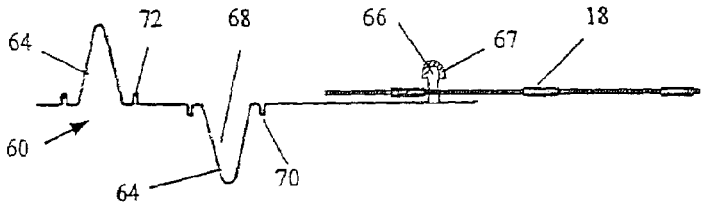
FIG. 14 is a cross-sectional view on the line 14-14 of FIG. 13, and including an attached sheet of geogrid.

FIGS. 13 and 14 illustrate a further embodiment of the interconnecting member. Interconnecting member 60 comprises a plate 62, generally rectangular and planar in a preferred embodiment, with a plurality of projections 64 extending perpendicularly from both sides of the plate. A set of geogrid-holding members 66 extends perpendicularly from the upper side of the plate along an edge thereof. Unlike the embodiment of FIG. 2, in which projections 24 serve both to attach the geogrid and to protrude into the wall-building units, geogrid-holding members 66 of interconnecting member 60 are specifically shaped to provide a very secure means of attachment to the geogrid. Geogrid-holding members 66 have relatively steep, almost vertical walls, and are sized and arrayed in a row along the edge of the plate to fit snugly into adjacent holes along the edge of the sheet of geogrid. Cap 67, which can be made of rubber or similar material, fits snugly over the top end of a member 66 and can optionally and preferably be put in place on one or more of members 66 after the geogrid 18 is fitted over the members 66 in order to better secure the attachment of the geogrid to the interconnecting member. The outer diameter of the cap 67 is larger than the diameter of the holes in the geogrid, thus restraining the geogrid from slipping up and off the members 66. The geogrid sheet 18 fits and is held on the member 66 between the plate 62 and the lower edge of the cap 67.

Projections 64 are preferably formed in plate 62 by pressing and molding the plate, resulting in a corresponding depression 68 in the opposite side of the plate. However, the projections can also be solid, as in the embodiment of FIG. 2.

As shown in FIGS. 13 and 14, a protruding ring or flange 70 is provided around the base of each projection 64 on the upper side of plate 62. The flange has an upper end or lip 72. Flange 70 has particular application when the interconnecting member is used in a wall in which the wall-building units are sand/soil bags. Here, there is a possibility that some of the projections 64 may puncture the bag placed on top of the interconnecting member, causing a leakage of sand from the bag. The function of flange 70 is to reduce such leakage by pressing against the bag and forming a seal around the projection 64 sufficient to reduce or stop the leakage of sand or soil from the hole. Optionally, and as illustrated in FIGS. 13 and 14, a flange 70 may also be provided on the lower side of the plate 62 to reduce leakage from a bag underneath plate 62 that is punctured by a projection 64 on the underside of plate 62.

The interconnecting member 60 can be configured so that, in use, the geogrid-holding members 66 are covered by the sand/soil bags that are above them. In this case, the distance between the row of members 66 and the row of projections 64 that is nearest to it is relatively small, so that the sand/soil bag on top of the interconnecting member 60 covers both the projections 64 and the geogrid-holding members 66. Alternatively, the interconnecting member 60 can be configured so that, in use, the geogrid-holding members 66 are not covered by the sand/soil bags that are above them. In this case the distance between the row of members 66 and the row of projections 64 that is closest to it is relatively large, so the section of the plate 62 bearing members 66 extends beyond sand/soil bags and is not covered by them. In this case, holes (not illustrated in the drawings) can be provided in plate 62 in the region between the row of geogrid-holding members 66 and the nearest row of projections 64 to facilitate water drainage through the retaining wall, and also to economize on material, i.e. to permit cheaper fabrication of the interconnecting members. It will be understood that these features, though described in relation to the embodiment of FIGS. 13 and 14, can equally be applied to the embodiments illustrated in FIGS. 15-16, 17-18, 19-20, 21-22, 23-24, 25-26, 27-28 and 29-30. Alternatively, the drainage holes can be provided in all embodiments of the interconnecting member.

Figure 15:
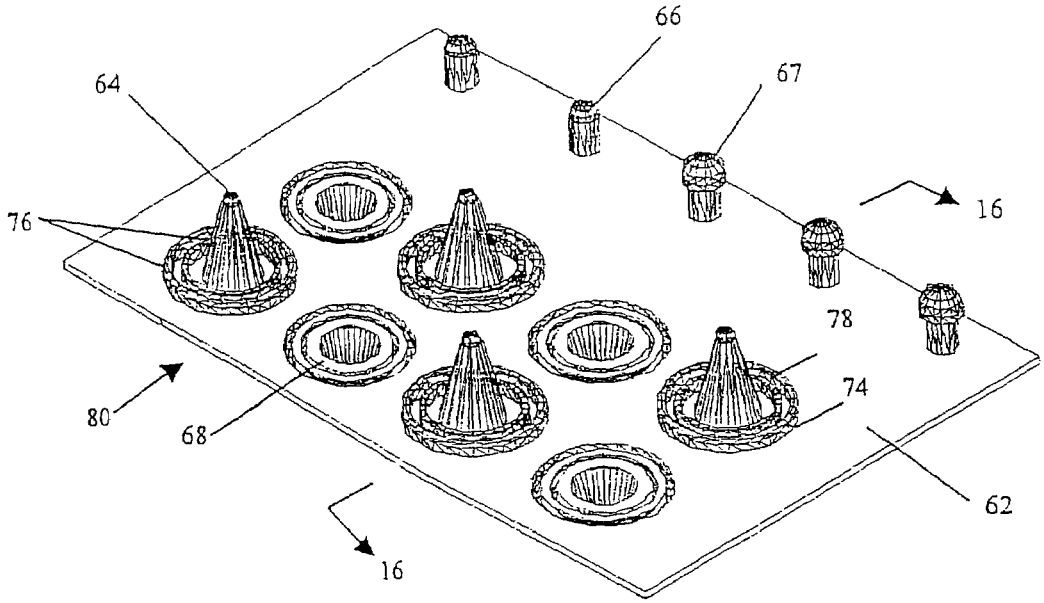
FIG. 15 is a perspective view of a further embodiment of the interconnecting member.
Figure 16:
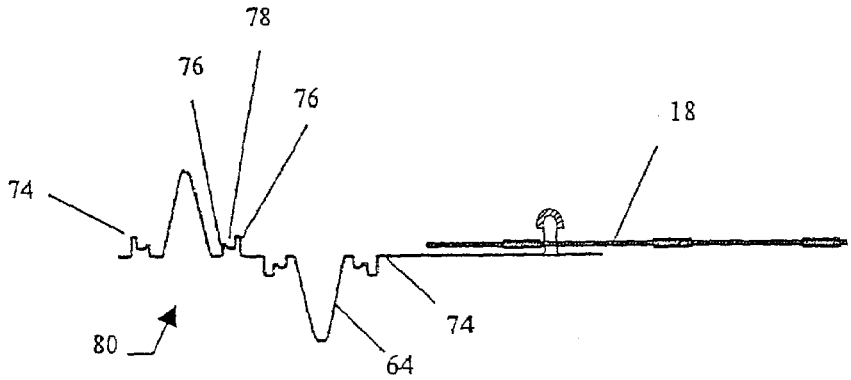
FIG. 16 is a cross-sectional view on the line 16-16 of FIG. 15, and including an attached sheet of geogrid.

FIGS. 15 and 16 show an alternative embodiment of the interconnecting members of FIGS. 13 and 14. The structure of interconnecting member 80 is the same as that of interconnecting member 60 shown in FIG. 14 except for the lip of the flange. Interconnecting member 80 has a flange 74 with a lip having two concentric ridges 76 with a concentric depression 78 therebetween. Both ridges 76 press against a sand/soil bag placed on top of the interconnecting member 72, forming, in effect, a double seal. The concentric ridges 76 on a lip may be the same height or different heights. In the latter case, the outer ridge 76 is preferably somewhat higher than the inner ridge, as illustrated in FIGS. 15 and 16, the object being to achieve the most effective seal possible around a projection 64 against a sand/soil bag punctured thereby. As for the embodiment of FIGS. 13-14, the flange 70 and ridges 74 may be on the upper side only of the interconnecting member or, optionally, on both the upper and lower sides.

It will be apparent that the geogrid-holding members 66 of the interconnecting member 60, 80 is a feature that can also be incorporated into the structure of the embodiments of the interconnecting member shown in FIGS. 2, 7 and 10; it is not limited to use in interconnecting members having flanges as depicted in FIGS. 13-16. Nor is the feature of flanges limited to interconnecting members having geogrid-holding members 66; either feature can be included in an interconnecting member with or without including the other.

Figure 17:
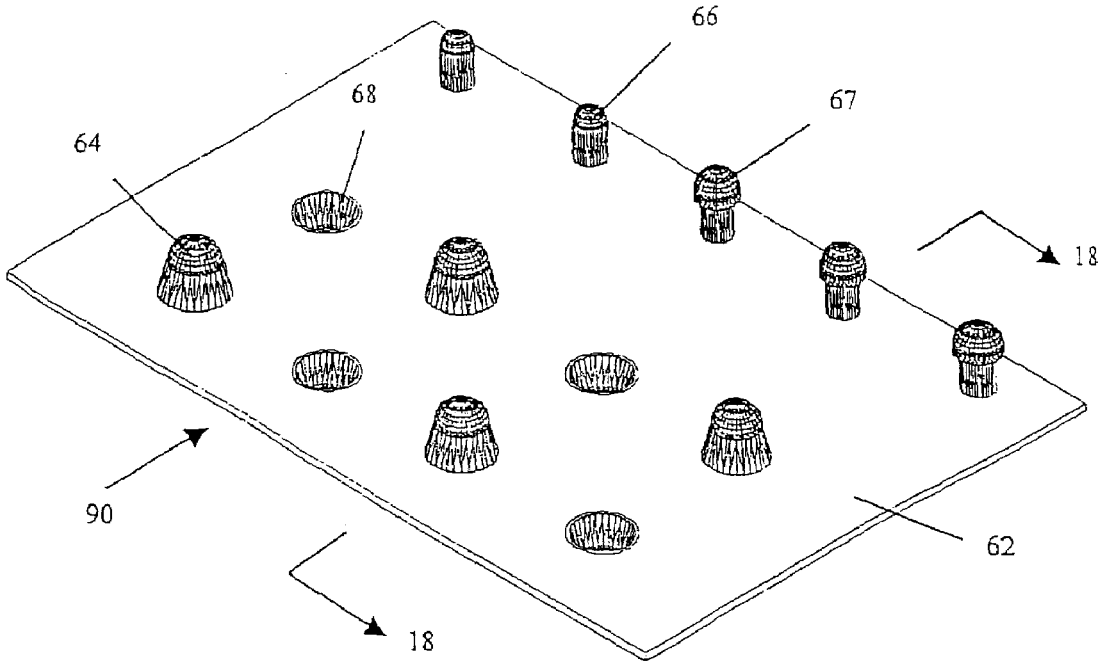
FIG. 17 is a perspective view of a further embodiment of the interconnecting member.
Figure 18:
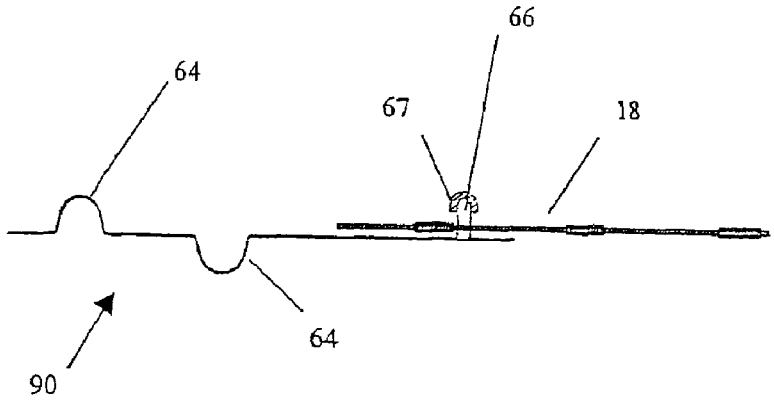
FIG. 18 is cross-sectional view on the line 18-18 of FIG. 17, and including an attached sheet of geogrid.

FIGS. 17 and 18 illustrate a further embodiment of the interconnecting member, indicated by reference numeral 90, which is substantially the same as the embodiment of FIGS. 13 and 14 except that the feature of sealing flanges around the projections 64 is not included.

FIGS. 19-30 illustrate embodiments of the interconnecting member in which the geogrid-holding members are configured in other forms for effective attachment to a sheet of geogrid.

Referring first to FIGS. 19-24, geogrid-holding member 94 is generally L-shaped, having a first, upright part 96 that projects upward from the plate 62, and a second, horizontal part 98 extending from the upright part towards the projection 64. When a sheet of geogrid 18 is fitted over retaining members 94, by inserting part 98 into a hole in the geogrid and pulling the geogrid down onto the upright part 96, the horizontal part 98 restrains the sheet from slipping off the retaining members 94.

Figure 19:
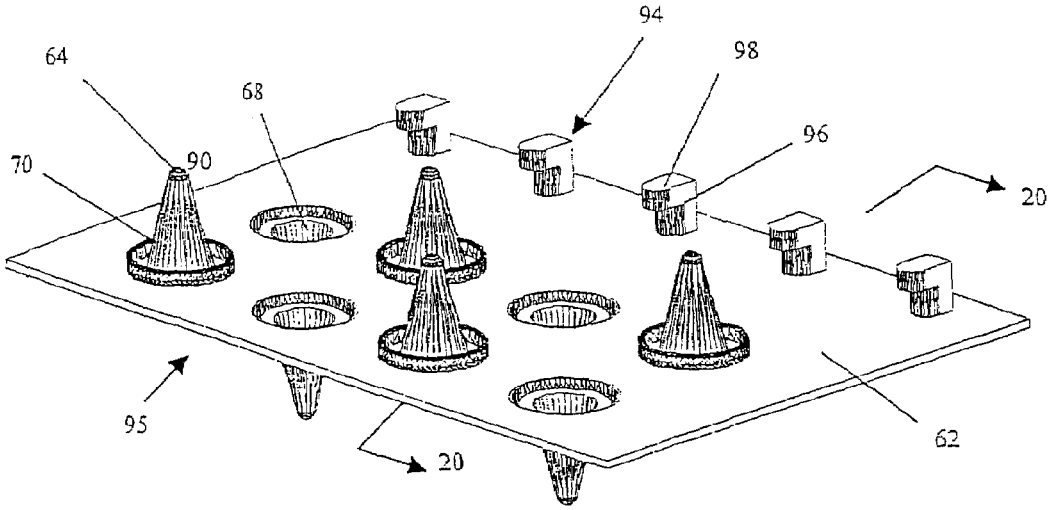
FIG. 19 is a perspective view of the further embodiment of the interconnecting member.
Figure 20:
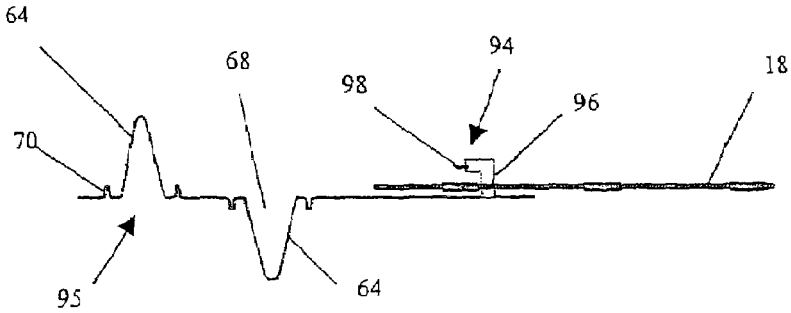
FIG. 20 is a cross-sectional view on the line 20-20 of FIG. 19, and including an attached sheet of geogrid.

FIGS. 19 and 20 illustrate an embodiment of the interconnecting member, indicated by reference numeral 95, having geogrid-holding members 94. The structure of the remainder of the interconnecting member 95 is the same as the embodiment illustrated in FIGS. 13-14.

Figure 21:
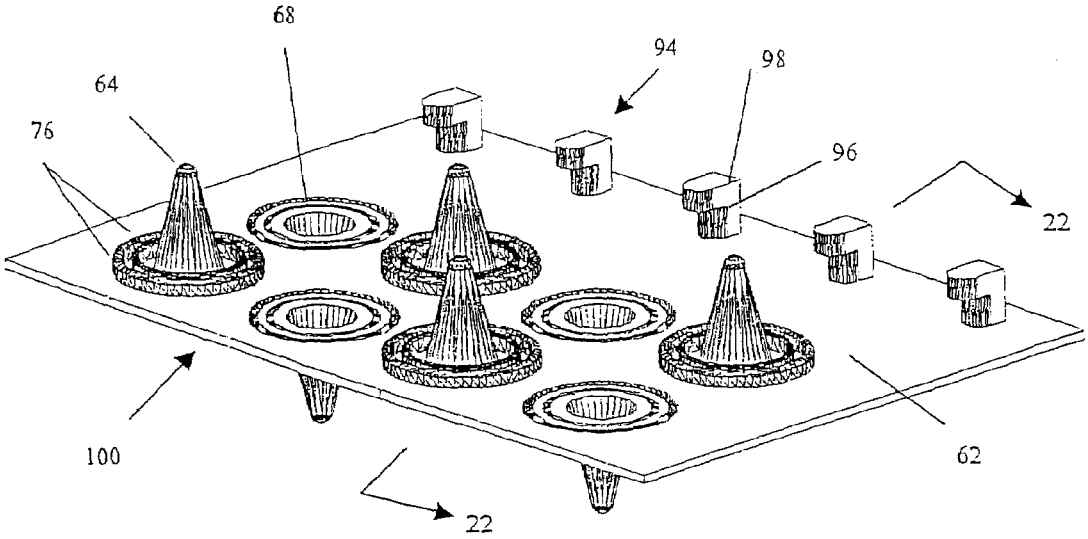
FIG. 21 is a perspective view of a further embodiment of the interconnecting member.
Figure 22:
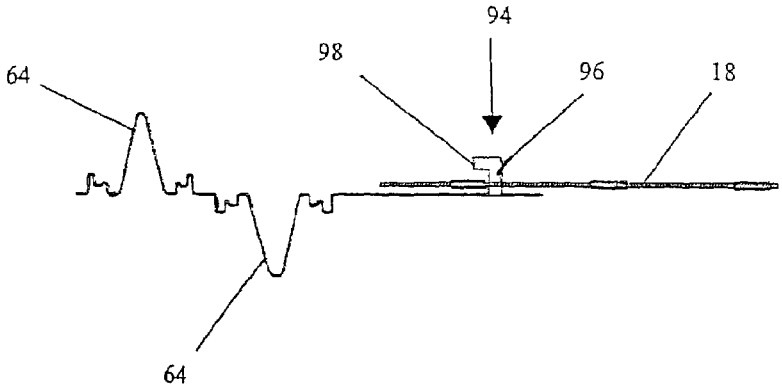
FIG. 22 is a cross-sectional view on the line 22-22 of FIG. 21, and including an attached sheet of geogrid.

FIGS. 21 and 22 illustrate a further embodiment of the interconnecting member, indicated by reference numeral 100, having geogrid retaining members 94. The structure of the remainder of the interconnecting member 100 is the same as the embodiment illustrated in FIGS. 15-16.

Figure 23:
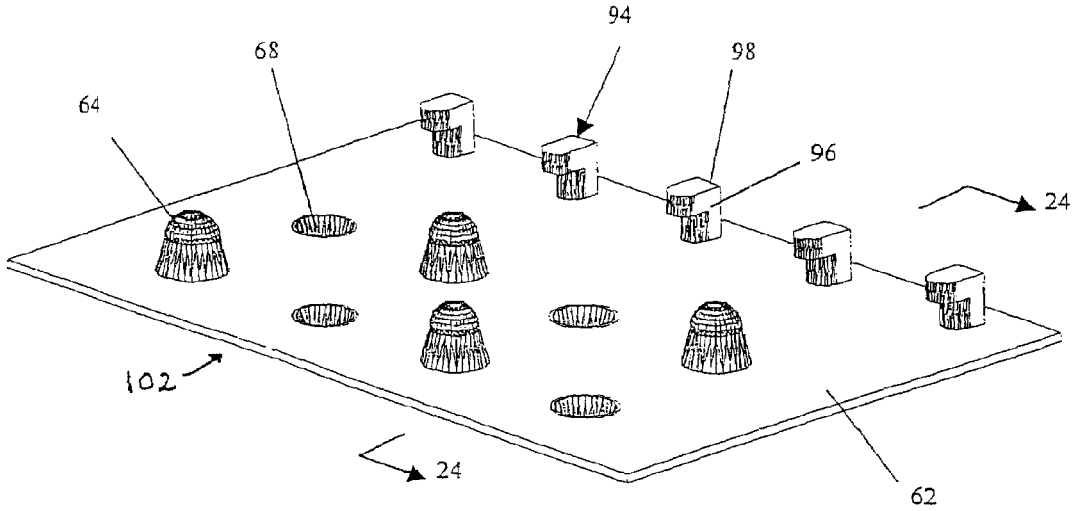
FIG. 23 is a perspective view of the further embodiment of the interconnecting member.
Figure 24:
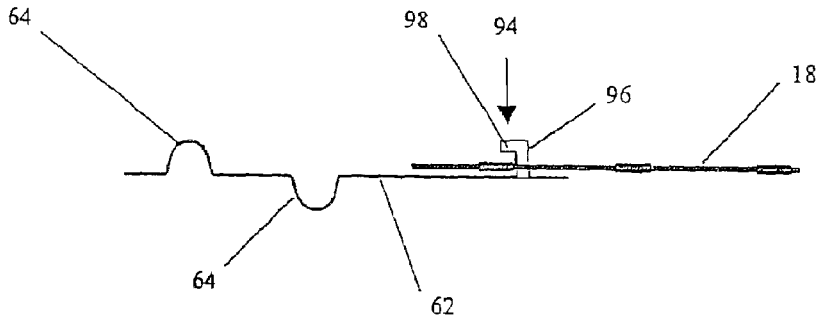
FIG. 24 is a cross-sectional view on the line 24-24 of FIG. 23, and including an attached sheet of geogrid.

FIGS. 23 and 24 illustrate a further embodiment of the interconnecting member, indicated by reference numeral 102, having geogrid-holding members 94. The structure of the remainder of the interconnecting member 102 is the same as the embodiment illustrated in FIGS. 17-18.

Referring next to FIGS. 25-30, geogrid holding member 104 is a tapered post with a relatively narrow base 109 and a relatively wide top 108. Member 104 is generally rectangular in horizontal cross-section. The side 106 nearest the projections 64 slopes towards the projections 64 in the upward direction. The top 108 of the member 104 is sized and configured to fit snugly into a hole in a sheet of geogrid. When a sheet of geogrid 18 is fitted over a set of geogrid-holding members 104 on an interconnecting member, the taper and the wide top of the geogrid-holding member 104 restrains the sheet from slipping off.

Figure 25:
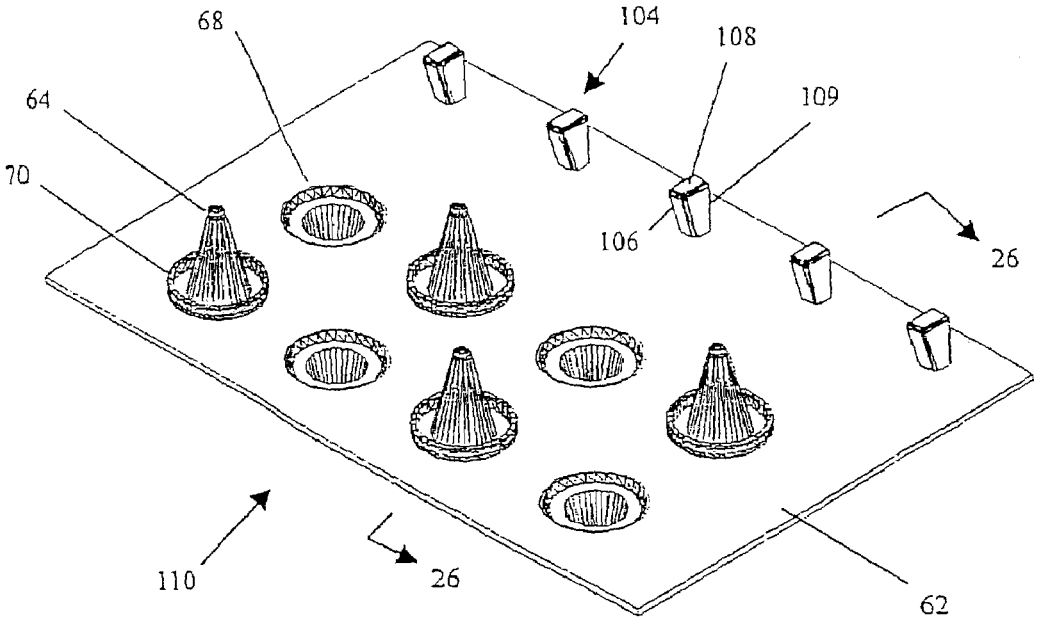
FIG. 25 is a perspective view of a further embodiment of the interconnecting member.
Figure 26:
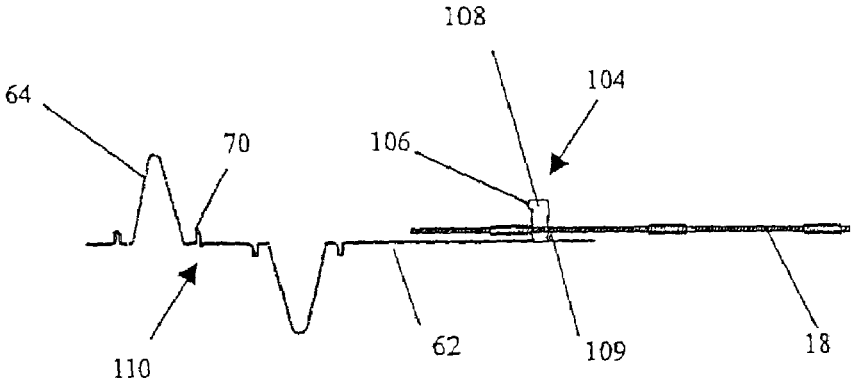
FIG. 26 is a cross-sectional view on the line 26-26 of FIG. 25, and including an attached sheet of geogrid.

FIGS. 25 and 26 illustrate an embodiment of the interconnecting member 110 having geogrid-holding members 104. The structure of the remainder of the interconnecting member 110 is the same as the embodiment illustrated in FIGS. 13-14.

Figure 27:
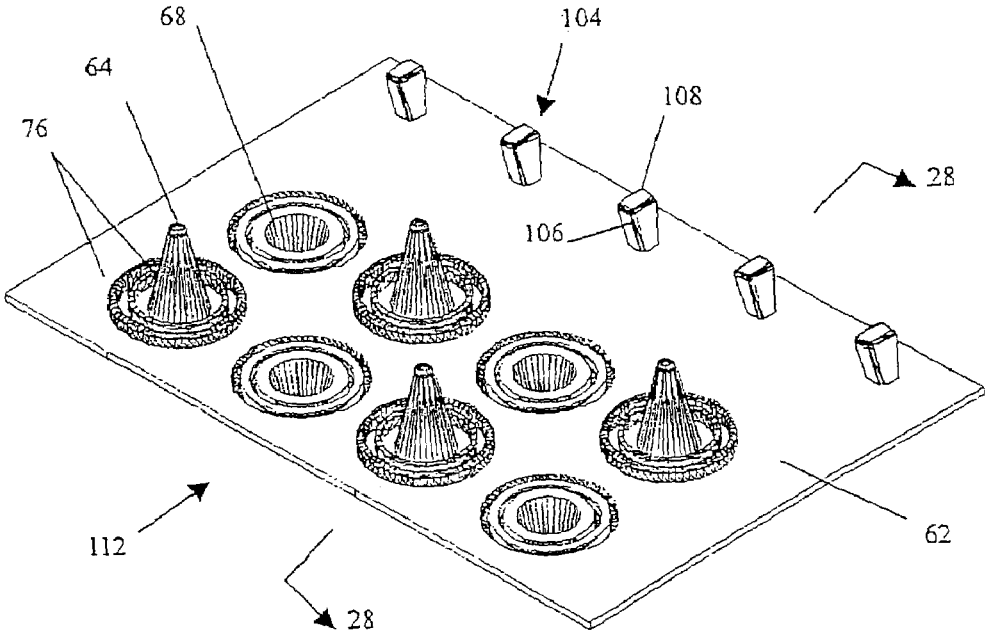
FIG. 27 is a perspective view of a further embodiment of the interconnecting member.
Figure 28:
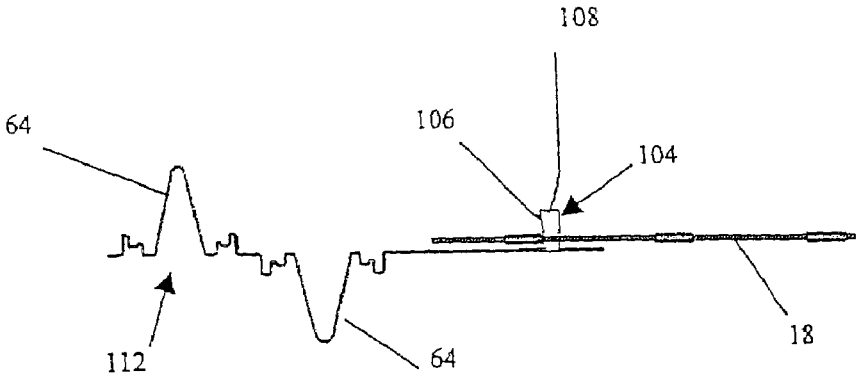
FIG. 28 is a cross-sectional view on the line 28-28 of FIG. 27, and including attached sheet of geogrid.

FIGS. 27 and 28 illustrate a further embodiment of the interconnecting member, indicated by reference numeral 112, having geogrid-holding members 104. The structure of the remainder of the interconnecting member 112 is the same as the embodiment illustrated in FIGS. 15-16.

Figure 29:
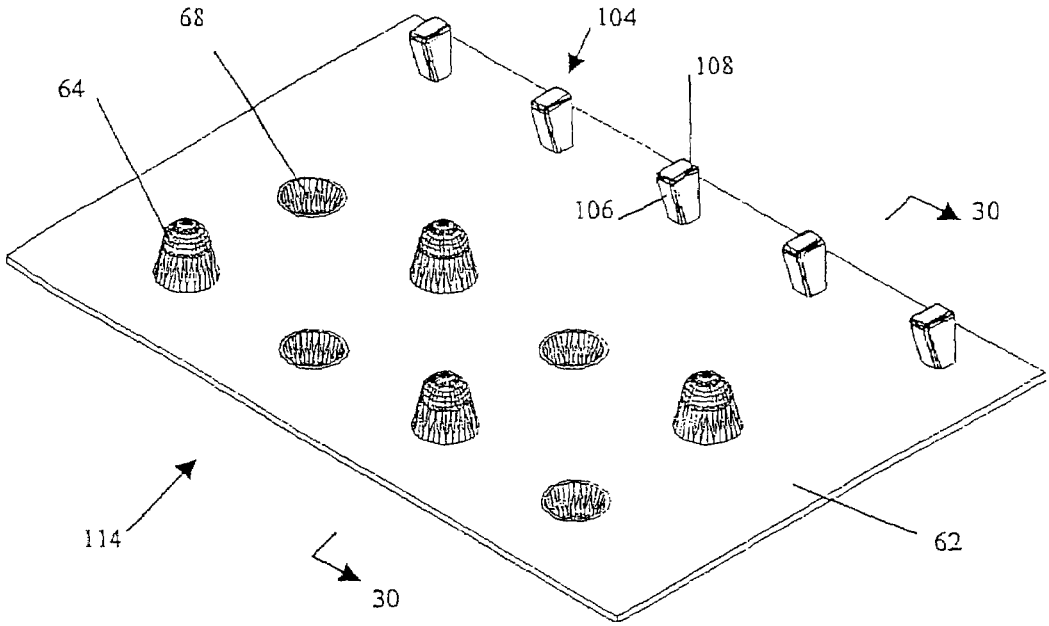
FIG. 29 is a perspective view of a further embodiment of the interconnecting member.
Figure 30:
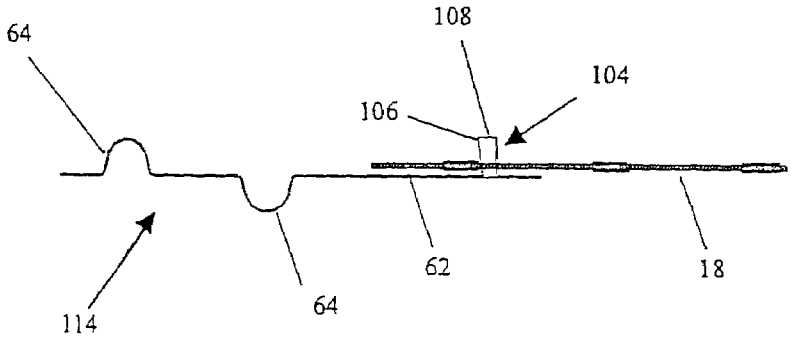
FIG. 30 is a cross-sectional view on the line 30-30 of FIG. 29, and including an attached sheet of geogrid.

FIGS. 29 and 30 illustrate a further embodiment of the interconnecting member, indicated by reference numeral 114, having geogrid-holding members 104. The structure of the remainder of the interconnecting member 114 is the same as the embodiment illustrated in FIGS. 17-18.

Figure 31:
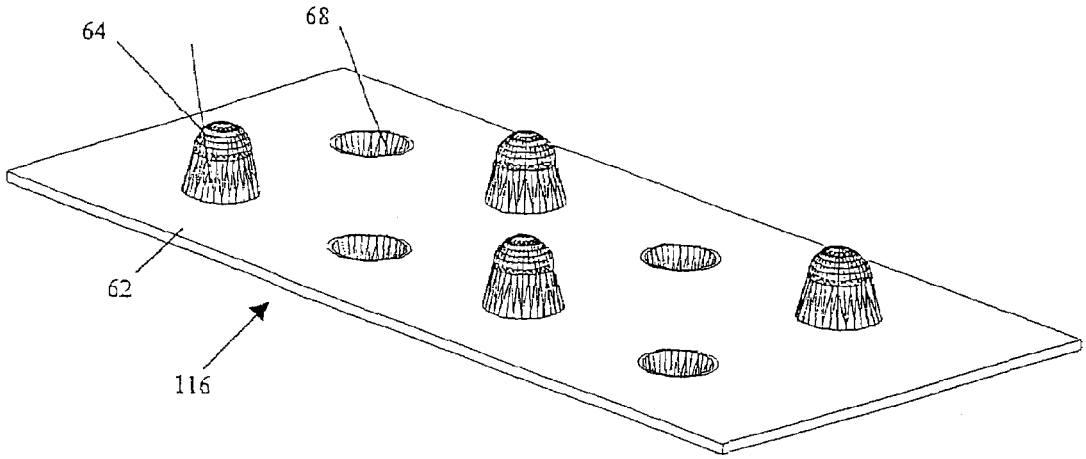
FIGS. 31-33 are perspective views of three further embodiments of the interconnecting member.
Figure 32:
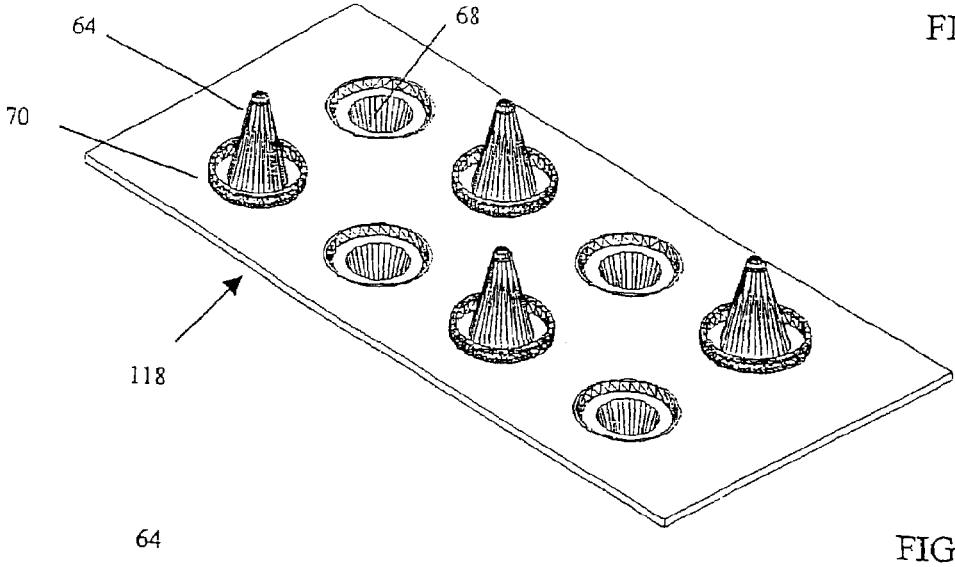
Figure 33:
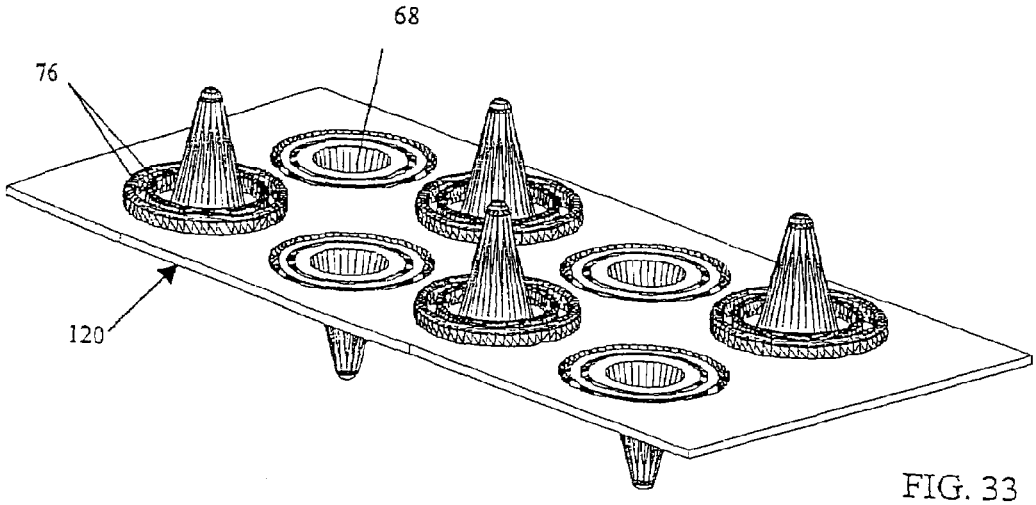

Interconnecting members according to the invention are also used in applications which do not include the use of geogrid, or in which geogrid is used but is not attached to the retaining wall. For such applications, the interconnecting member does not include geogrid-holding members as described above. FIGS. 31-33 illustrate further embodiments of such interconnecting members. FIG. 31 shows an interconnecting member 116 which is similar in structure to the one illustrated in FIGS. 17-18, but does not include any geogrid-holding members. FIG. 32 shows an interconnecting member 118 which is similar in structure to the one illustrated in FIGS. 13-14, but does not include any geogrid members. FIG. 33 shows an interconnecting member 120 which is similar in structure to the one illustrated in FIGS. 15-16, but does not include any geogrid-holding members.

Figure 12:
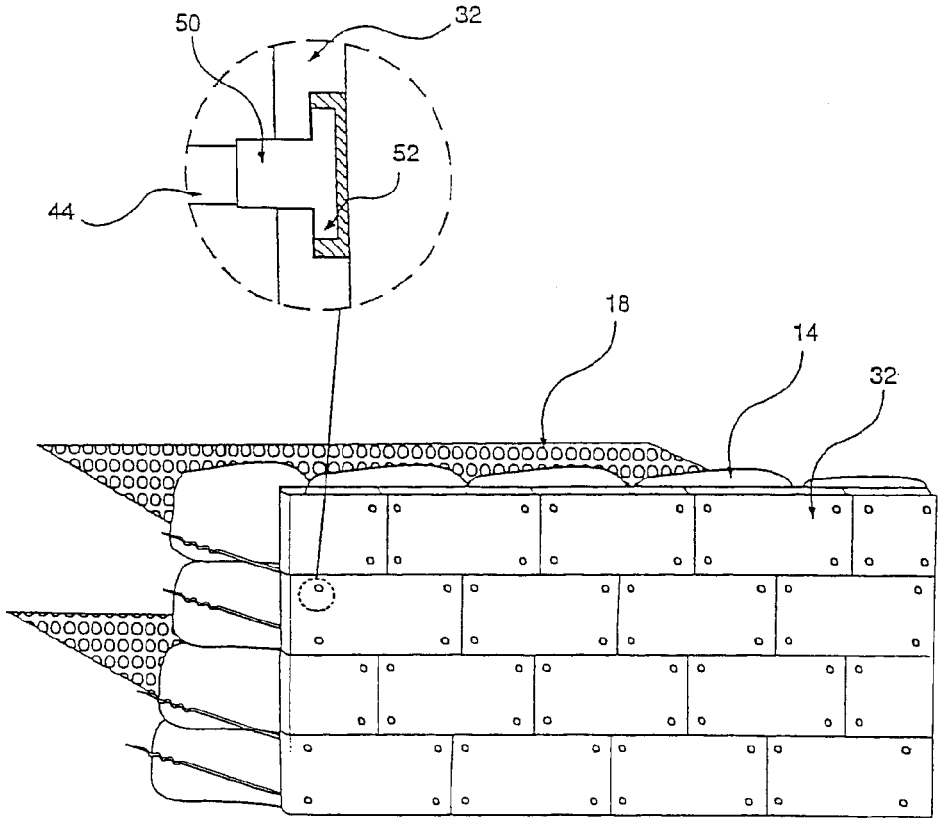
FIG. 12 is a perspective view of a wall with the cover plate assemblies affixed thereto.
Figure 11A:
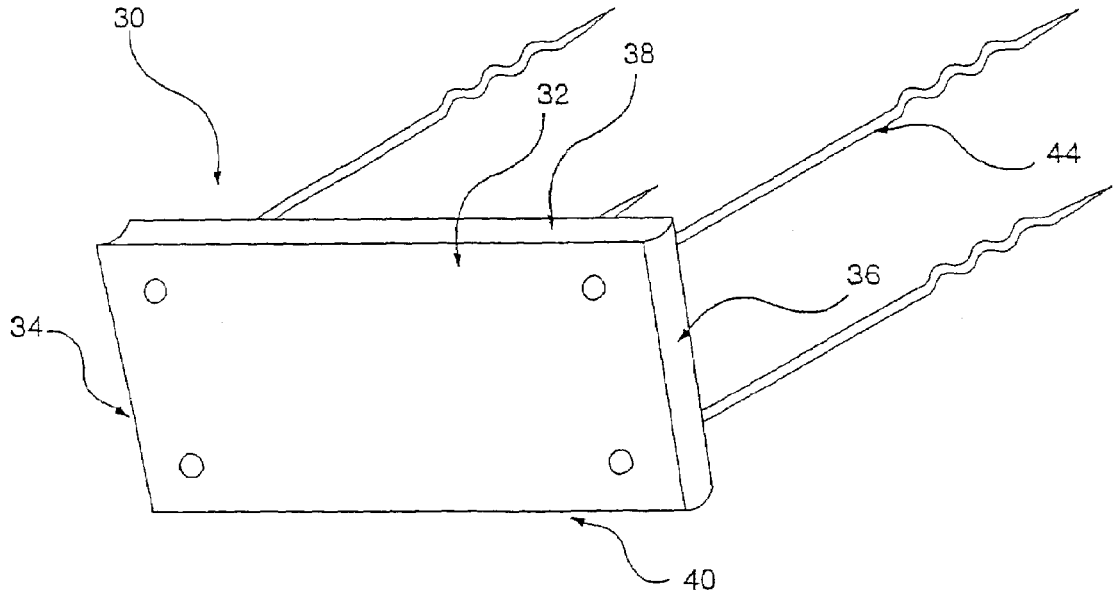
FIGS. 11(*a*) to (*c*) are perspective views of the cover plate assembly and the parts thereof.
Figure 11B:
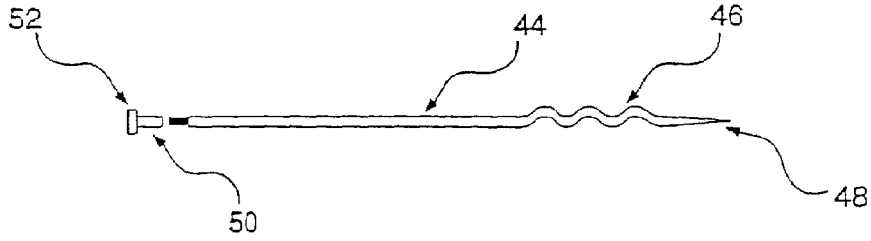
Figure 11C:
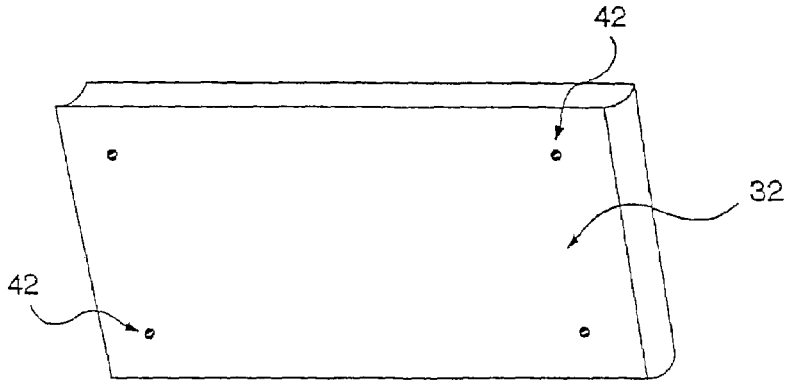

Retaining walls of the invention can optionally include cover plates which attach to the face of the wall. Referring to FIGS. 11 and 12, the cover plate assembly 30 has a generally rectangular cover plate 32, which can be made of wood, concrete, plastic or other materials. Plate 32 has opposed edges 34, 36 and 38, 40 and is provided with a bore 42 in each corner adapted to receive an attachment rod 44. As shown in FIG. 11(*b*), attachment rod 44 has a sinuous portion 46 and point 48 at one end and is threaded at the other end to engage into nut 50 which has head 52. Attachment rod 44 is affixed to cover plate 32 by inserting it through bore 42 and engaging it with nut 50.

Cover plate assembly 30 has particular application to retaining walls of the invention when made of sand/soil bags, or of hardenable building materials such as bags of cement and aggregate (rather than to walls made of freshly-formed molded blocks) to improve the durability and appearance of such walls. A cover plate assembly is attached to the wall by pressing the pointed ends of rods 44 through the bags until the inner side of the cover plate 32 abuts the wall. The sinuous portions 46 of the rods 44 enhance the engagement of the rods in the fill material of the sand/soil bags or in the material of the hardenable building units. Additional cover plate assemblies are affixed to the wall, abutting each other, to form a substantially complete cover. As shown in FIG. 11, the opposed edges 34, 36 and 38, 40 are alternately concave and convex, so the edges of abutting covers nest together to align the covers and provide some engagement. Preferably, the covers are positioned so as to a form a staggered, brick wall-type array, illustrated in FIG. 12.

Rods 44 can optionally have different means for engagement in the fill material of the sand/soil bags or in the hardenable building units instead of sinuous portion 46. For example rods 44 can have threads, ridges or other structures for engagement.

As will be apparent to those skilled in the art in the light of the foregoing disclosure, many alterations and modifications are possible in the practice of this invention without departing from the spirit or scope thereof. For example, the interconnecting member can be made flexible to conform to the shape of the wall-building units. The projections on it can be barbed, to enhance their attachment to the wall-building units, and they can project at angles other than the vertical from the plate. Accordingly, the scope of the invention is to be construed in accordance with the substance defined by the following claims.

What is claimed is:

1. A retaining wall structure comprising a first plurality of hardenable building units positioned adjacent to one another forming a first horizontally-extending course, a second plurality of hardenable building units positioned adjacent to one another above said first course forming a second horizontally-extending course, and interconnecting members between said first course and said second course, said interconnecting members comprising a body having an upper side and a lower side, each said side having a plurality of projections thereon, said projections being capable of protruding into said hardenable building units in said first course and said second course, said body extending across at least part of two horizontally-adjacent hardenable building units in said first course or said second course, with said projections on said upper side or said lower side positioned to protrude into said two horizontally-adjacent hardenable building units, said projections on said lower side comprising at least three projections positioned on said lower side to support said body in a generally horizontal position on said first course when said interconnecting member is placed on said first course.

2. A retaining wall structure according to claim 1 further comprising a sheet of geogrid extending from between said first and second courses into fill behind said retaining wall structure, said geogrid sheet having a plurality of holes therein, and said geogrid sheet being so positioned that at least some of said projections on said upper side or said lower side of said plate protrude through said holes of said geogrid sheet.

3. A retaining wall structure according to claim 1 further comprising a plurality of said interconnecting members positioned on ground supporting said retaining wall structure, and said first plurality of hardenable building units is positioned on said plurality of interconnecting members with said projections on said upper side of said plurality of interconnecting members protruding into said plurality of hardenable building units.

4. A retaining wall structure according to claim 1 wherein said hardenable building units comprise reinforcement elements.

5. A retaining wall structure according to claim 4 wherein said reinforcement elements comprise one or more of fibers, wires and strips.

6. A retaining wall structure comprising a first plurality of hardenable building units positioned adjacent to one another forming a first horizontally-extending course, a second plurality of hardenable building units positioned adjacent to one another above said first course forming a second horizontally-extending course, and interconnecting members between said first course and said second course, said interconnecting members comprising a body with projections capable of protruding into said hardenable building units in said first course and in said second course, characterized in that said body has an upper side and a lower side, each said side having a plurality of projections thereon, said body extending across at least part of two horizontally-adjacent hardenable building units in said first course or said second course, with said projections on said upper side or said lower side positioned to protrude into said two horizontally-adjacent hardenable building units, wherein said interconnecting member further comprises a set of geogrid-holding members on the upper side of said body shaped and adapted to protrude through holes in a sheet of geogrid, and wherein said retaining wall structure further comprises a sheet of geogrid extending from between said first and second courses into fill behind said retaining wall structure, said geogrid sheet having a plurality of holes therein and said geogrid sheet being so positioned that said geogrid-holding members protrude through said holes of said geogrid sheet.

7. A retaining wall structure comprising a first plurality of hardenable building units positioned adjacent to one another forming a first horizontally-extending course, a second plurality of hardenable building units positioned adjacent to one another above said first course forming a second horizontally-extending course, and interconnecting members between said first course and said second course, said interconnecting members comprising a body with projections capable of protruding into said hardenable building units in said first course and in said second course, characterized in that said body has an upper side and a lower side, each said side having a plurality of projections thereon, said body extending across at least part of two horizontally-adjacent hardenable building units in said first course or said second course, with said projections on said upper side or said lower side positioned to protrude into said two horizontally-adjacent hardenable building units, wherein said body of said interconnecting member has one or more water drainage holes.

8. A retaining wall structure comprising a first plurality of wall-building units positioned adjacent to one another forming a first horizontally-extending course, a second plurality of wall-building units positioned adjacent to one another above said first course forming a second-horizontally-extending course, and interconnecting members between said first course and said second course, said interconnecting members comprising a body with projections capable of protruding into said wall-building units in said first course and in said second course, said body having an upper side and a lower side, each said side having a plurality of projections thereon, said body extending across at least part of two horizontally-adjacent wall-building units in said first course or said second course, with said projections on said upper side or said lower side positioned to protrude into said two horizontally-adjacent wall-building units, said projections on said lower side comprising at least three projections positioned on said lower side to support said body in a generally horizontal position on said first course when said interconnecting member is placed on said first course.

9. A retaining wall structure according to claim 8, further comprising a plurality of said interconnecting members positioned on ground supporting said retaining wall structure, and said first plurality of wall-building units is positioned on said plurality of interconnecting members with said projections on said upper side of said plurality of interconnecting members protruding into said plurality of wall-building units.

10. A retaining wall structure according to claim 8 wherein said body of said interconnecting member has one or more water drainage holes.

11. A retaining wall structure according to claim 8 wherein said wall-building units have a length and a width and opposed ends, said length being greater than said width, said retaining wall structure forming a wall face of a slope, said wall- building units within said courses being positioned adjacent to one another side to side along their said lengths such that one said end of each said wall-building unit forms part of an inner side of said wall face adjacent said slope and said opposed end of said wall- building unit forms a part of an outer side of said wall face, adjacent said interconnecting members along a given said course alternating between a position proximate to said inner side of said wall face and a position proximate to said outer side of said wall face.

12. A method of constructing a retaining wall structure having a plurality of courses of hardenable building units, comprising the steps of placing a first plurality of hardenable building units adjacent to one another to form a first horizontally-extending course, placing interconnecting members on said first course, said interconnecting members comprising a body with projections capable of protruding into said hardenable building units in vertically adjacent courses, placing a second plurality of hardenable building units adjacent to one another to form a second horizontally-extending course above said first course such that said projections protrude into said hardenable building units of said second course, said body having an upper side and a lower side, each said side having a plurality of projections thereon, said body extending across at least part of two horizontally-adjacent hardenable building units in said first course or in said second course, with said projections on said upper side or said lower side protruding into said two horizontally-adjacent hardenable building units, said projections on said lower side comprising at least three projections positioned on said lower side to support said body in a generally horizontal position on said first course when said interconnecting member is placed on said first course, and allowing or causing said hardenable building units to harden.

13. A method according to claim 12 wherein said interconnecting member further comprises a set of geogrid-holding members on said upper side of said body shaped and adapted to protrude through holes in a sheet of geogrid, and said method further comprises the step of affixing a sheet of geogrid to said interconnecting member extending into fill behind said retaining wall structure.

* * * * *